US011465409B2

(12) United States Patent
Ono et al.

(10) Patent No.: US 11,465,409 B2
(45) Date of Patent: Oct. 11, 2022

(54) IMAGE RECORDING APPARATUS

(71) Applicant: BROTHER KOGYO KABUSHIKI KAISHA, Nagoya (JP)

(72) Inventors: Yasuo Ono, Nagoya (JP); Tsuyoshi Ito, Nagoya (JP); Masao Mimoto, Kitanagoya (JP); Satoru Arakane, Nagoya (JP); Hirotoshi Maehira, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 14 days.

(21) Appl. No.: 17/212,143

(22) Filed: Mar. 25, 2021

(65) Prior Publication Data

US 2021/0300025 A1 Sep. 30, 2021

(30) Foreign Application Priority Data

Mar. 30, 2020 (JP) ..... JP2020-060340

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04586; B41J 2/04536; B41J 2/04505; B41J 2/2132; G06K 15/102
See application file for complete search history.

(56) References Cited

U.S. PATENT DOCUMENTS

| | | | | |
|---|---|---|---|---|
| 5,044,796 | A | 9/1991 | Lund | |
| 5,511,890 | A | 4/1996 | Momose | |
| 5,819,009 | A | 10/1998 | Nakagawa | |
| 5,953,496 | A | 9/1999 | Ishida et al. | |
| 2003/0184609 | A1* | 10/2003 | Bates | B41J 11/425 347/19 |

FOREIGN PATENT DOCUMENTS

| | | | |
|---|---|---|---|
| JP | H02-233275 | A | 9/1990 |
| JP | H05-169648 | A | 7/1993 |
| JP | H05-176142 | A | 7/1993 |
| JP | H08-11353 | A | 1/1996 |
| JP | H10-76708 | A | 3/1998 |
| JP | 2002-103720 | A | 4/2002 |

* cited by examiner

*Primary Examiner* — Thinh H Nguyen
(74) *Attorney, Agent, or Firm* — Scully, Scott, Murphy & Presser, PC

(57) ABSTRACT

A controller acquires image recording data for recording a plurality of passes; determines a first movement distance of a carriage for recording each of the plurality of passes; determines a non-usage ratio that is a ratio of a number of unused nozzles in a last pass of the plurality of passes to a total number of the plurality of nozzles arranged in a conveyance direction; determines a second movement distance in a particular pass which is recorded before the last pass, the second movement distance being a movement distance of the carriage assuming that the particular pass is recorded without using nozzles of a first ratio smaller than or equal to the non-usage ratio; and in response to determining that the second movement distance is shorter than the first movement distance, performs image recording of the particular pass without using the nozzles of the first ratio.

5 Claims, 14 Drawing Sheets

IMAGE RECORDING APPARATUS

CROSS REFERENCE TO RELATED APPLICATIONS

This application claims priority from Japanese Patent Application No. 2020-060340 filed Mar. 30, 2020. The entire content of the priority application is incorporated herein by reference.

TECHNICAL FIELD

This disclosure relates to an image recording apparatus.

BACKGROUND

A recording apparatus is disclosed in which a carriage having a recording head mounted thereon is scanned above a recording medium for recording. The recording apparatus generates carriage movement paths corresponding to both ends of the rectangular data to be recorded in one scan, and selects the carriage movement path in which the total of the movement paths in each scan is the shortest.

SUMMARY

According to one aspect, this specification discloses an image recording apparatus. The image recording apparatus includes a conveyor, a carriage, a head, and a controller. The conveyor is configured to convey a sheet in a conveyance direction. The carriage is configured to move in a scanning direction crossing the conveyance direction. The head is mounted on the carriage. The head has a plurality of nozzles arranged in the conveyance direction. The controller is configured to record an image formed by a plurality of passes on a sheet by repeatedly controlling the head to eject liquid from the plurality of nozzles while moving the carriage in the scanning direction, and controlling the conveyor to convey the sheet in the conveyance direction. The controller is configured to: acquire image recording data including a plurality of pass image data for recording the plurality of passes; determine, based on the image recording data, a first movement distance of the carriage for recording each of the plurality of passes, the first movement distance being a movement distance of the carriage assuming that each of the plurality of passes is recorded by using all of the plurality of nozzles; determine, based on the image recording data, a non-usage ratio that is a ratio of a number of unused nozzles in a last pass of the plurality of passes to a total number of the plurality of nozzles arranged in the conveyance direction, the unused nozzles including a most upstream nozzle in the conveyance direction and nozzles continuously arranged from the most upstream nozzle toward downstream in the conveyance direction; determine, based on the image recording data, a second movement distance in a particular pass which is recorded before the last pass, the second movement distance being a movement distance of the carriage assuming that the particular pass is recorded without using nozzles of a first ratio, the first ratio being smaller than or equal to the non-usage ratio; and in response to determining that the second movement distance is shorter than the first movement distance, perform image recording of the particular pass without using the nozzles of the first ratio.

BRIEF DESCRIPTION OF THE DRAWINGS

Embodiments in accordance with this disclosure will be described in detail with reference to the following figures wherein.

DETAILED DESCRIPTION

Figure 1:
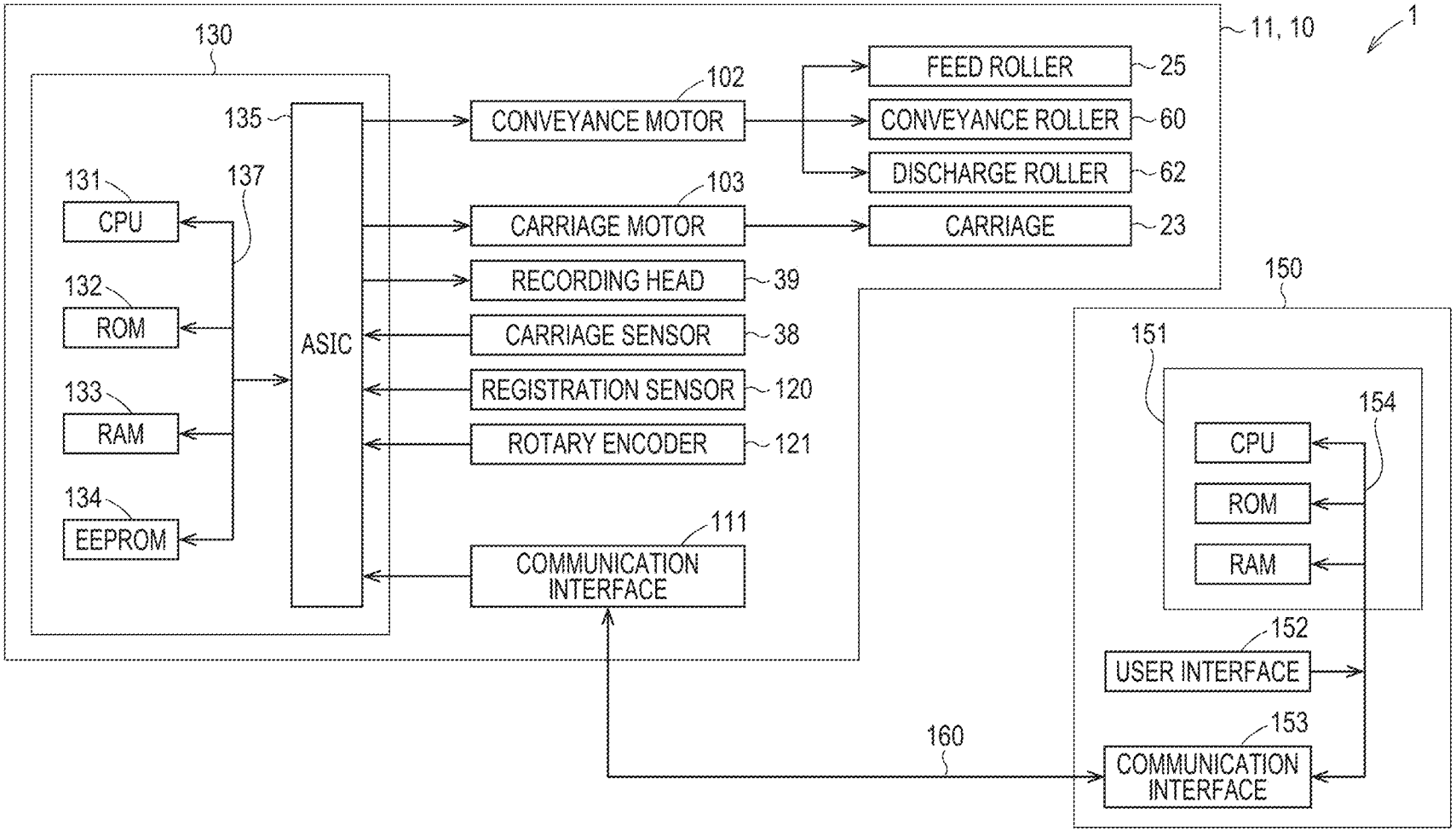
FIG. 1 is a block diagram showing the configuration of a system 1.

A head has a plurality of nozzles arranged along a conveyance direction of a sheet. In one scan, ink droplets are ejected from each of the plurality of nozzles to perform image recording. In the above-mentioned recording apparatus, at both ends of the rectangular data recorded in one scan, ink is not necessarily ejected from all the nozzles arranged in the conveyance direction. For example, there is a case where ink is ejected only from some nozzles located upstream in the conveyance direction, and ink is not ejected from the remaining nozzles located downstream of these nozzles in the conveyance direction. In such a case, regarding the remaining nozzles that do not eject ink, the carriage is scanned although the ink is not ejected.

In view of the foregoing, an aspect of an objective of this disclosure is to provide a technique for, when image recording is performed by a plurality of passes continuing in a conveyance direction, reducing the movement distance of a carriage without increasing the total number of passes.

Hereinafter, embodiments of the present disclosure will be described with reference to the drawings as appropriate. In the following description, a vertical direction 7 is defined based on the state (the state of FIG. 2) in which a multifunction peripheral (MFP) 10 is usable, a front-rear direction 8 is defined with a surface having an opening 13 as the front side (a front surface 17), and a left-right direction 9 is defined when the MFP 10 is viewed from the front side (the front surface 17 side). The vertical direction 7, the front-rear direction 8 and the left-right direction 9 are perpendicular to each other. In the following description, the direction from the start point to the end point of an arrow is expressed as an orientation, and the line connecting the start point and the end point of the arrow is expressed as a direction. In other words, an orientation is a component of a direction.

[Overall Configuration of System 1]

As shown in FIG. 1, a system 1 includes a multifunction peripheral (MFP) 10 and at least one information processing apparatus 150. The MFP 10 and the information processing apparatus 150 communicate data with each other through a data transmission line 160. The data transmission line 160 is a communication network including a wired LAN, a wireless LAN, a WAN, or a combination thereof. The data transmission line 160 may include a USB cable. The MFP 10 is configured to at least receive data from the information processing apparatus 150. Hereinafter, specific configurations of the MFP 10 and the information processing apparatus 150 will be described.

[Overall Configuration of MFP 10]

Figure 2:
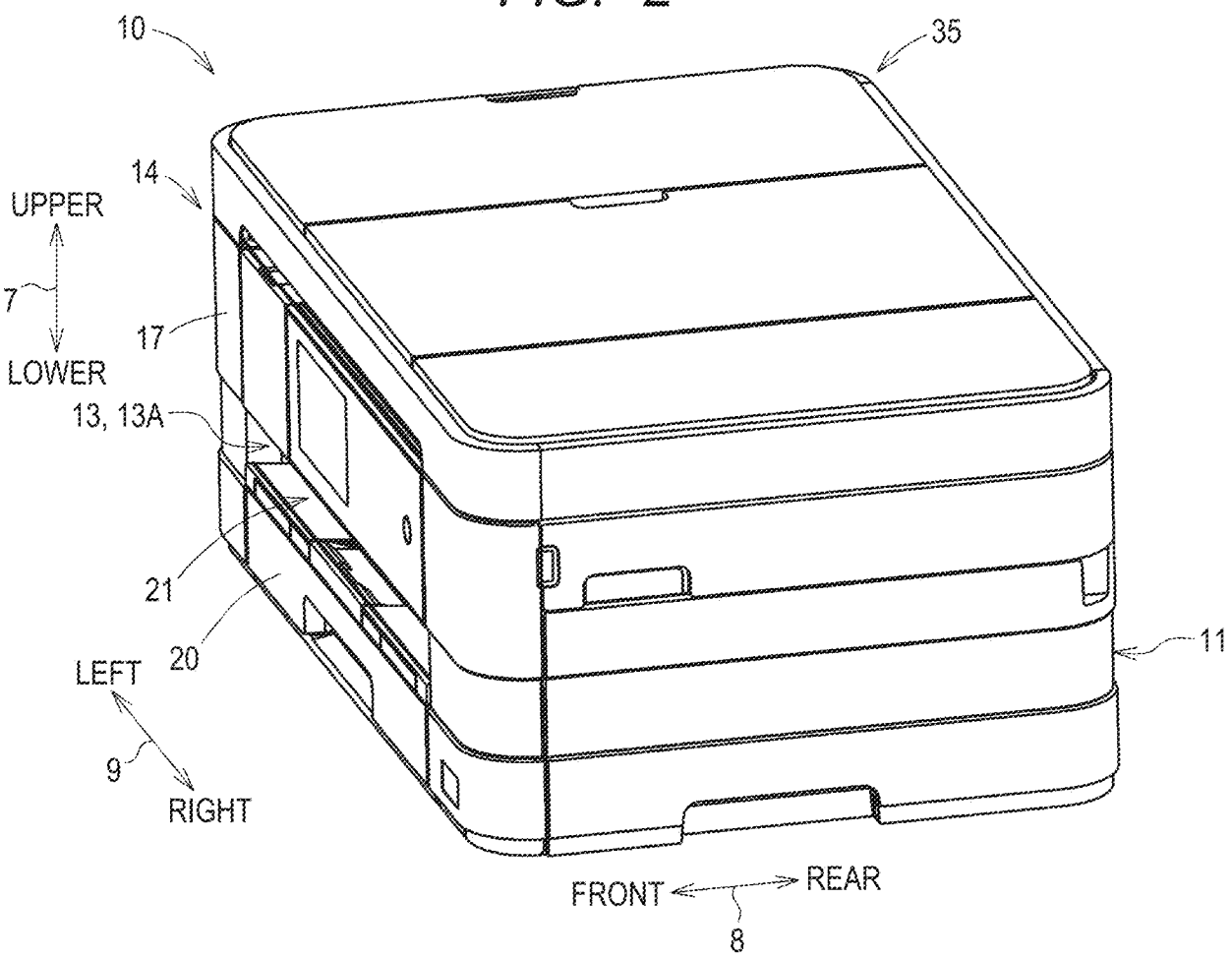
FIG. 2 is an external perspective view of a multifunction peripheral 10.

The MFP 10 is an example of an image recording apparatus, and has a plurality of functions including a print function and a scan function. As shown in FIG. 2, the MFP 10 includes a housing 14 having a substantially rectangular parallelepiped outer shape. The housing 14 includes an exterior body and a frame. The MFP 10 includes a scanner unit 35 having a scan function in the upper part of the housing 14, and includes a printer unit 11 in the lower part of the housing 14. The printer unit 11 has a print function and records an image on a sheet 12 (see FIG. 3) by an inkjet method. The sheet 12 is a paper, an OHP sheet, and so on.

Figure 3:
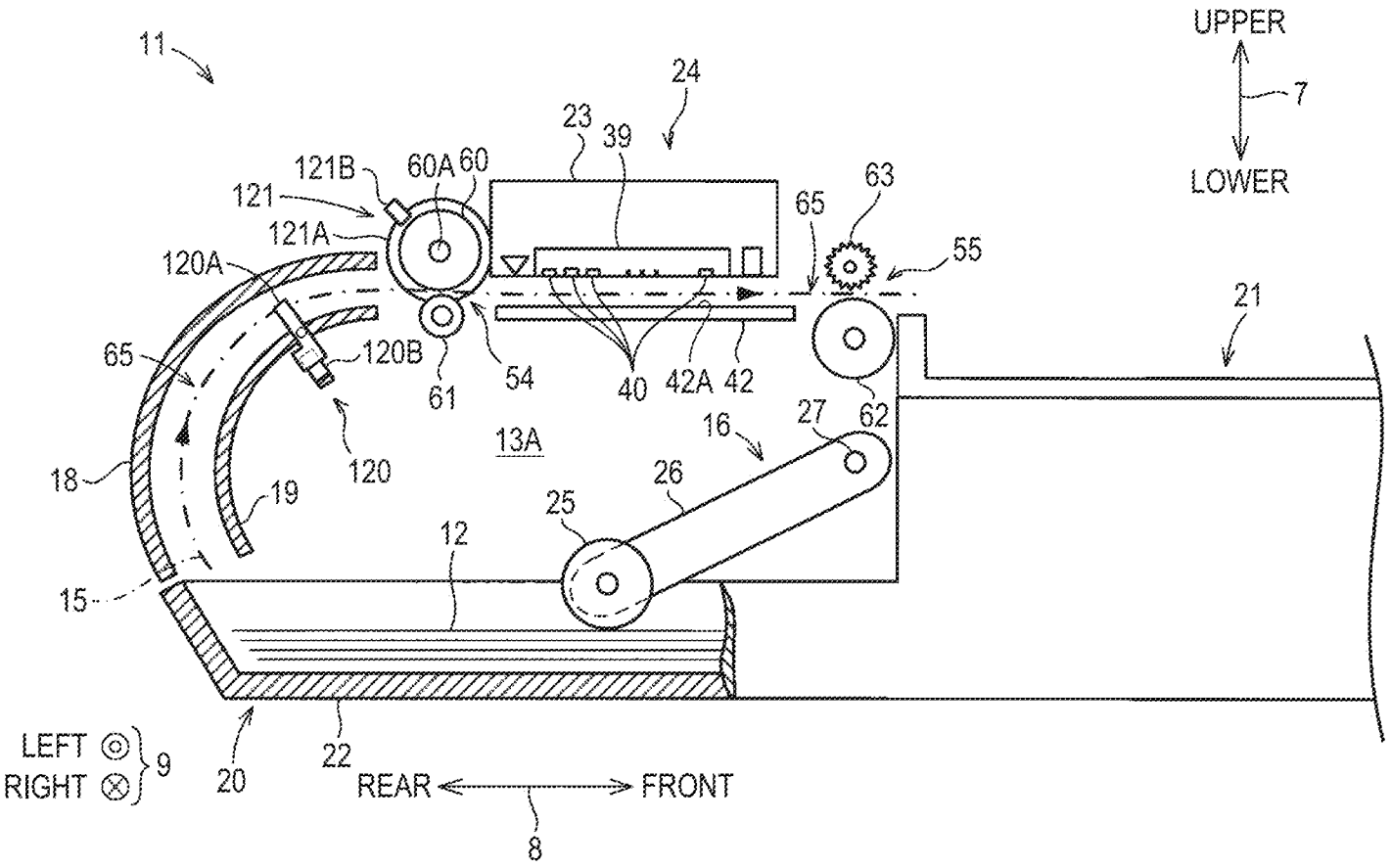
FIG. 3 is a vertical cross-sectional view schematically showing the internal structure of a printer unit 11.

As shown in FIG. 3, the printer unit 11 includes a supply tray 20, a discharge tray 21, a feed mechanism 16, a conveyance path 65, a conveyance roller pair 54, a recording unit (print engine) 24, and a discharge roller pair 55.

As shown in FIG. 2, an opening 13 is formed in the front surface 17 of the housing 14. The opening 13 is opened toward the front of the housing 14. As shown in FIG. 3, an internal space 13A is formed in the housing 14 (see FIG. 3). The internal space 13A communicates with the external space of the housing 14 through the opening 13 (see FIG. 2).

The supply tray 20 is inserted into the internal space 13A (see FIG. 3) of the housing 14 through the opening 13. Further, the supply tray 20 is removed from the housing 14 by being pulled out from a mount position toward the front. FIGS. 2 and 3 show the supply tray 20 located at the mount position.

The supply tray 20 has a box shape which is thin in the vertical direction 7. The supply tray 20 supports a plurality of sheets 12 in a stacked state. The sheet 12 is positioned with reference to the center of the supply tray 20 in the left-right direction 9.

The discharge tray 21 supports the sheet 12 on which an image is recorded. As shown in FIGS. 2 and 3, the discharge tray 21 is supported by the supply tray 20 and is located above the supply tray 20.

[Feed Mechanism 16]

As shown in FIG. 3, the feed mechanism 16 is located between a bottom wall 22 at the mount position and a platen 42 in the vertical direction 7. The feed mechanism 16 includes a feed roller 25 and a feed arm 26. The feed roller 25 is supported at the tip end of the feed arm 26 so as to be rotatable about its own axis. The base end of the feed arm 26 is located upward and forward of the tip end. The feed arm 26 has a support shaft 27 at the base end. The feed arm 26 is supported by the frame of the housing 14 so as to be rotationally movable about the axis of the support shaft 27.

The feed arm 26 houses a drive transmission mechanism (not shown) inside. The drive transmission mechanism includes a plurality of gears or endless belts, and transmits the driving force of a conveyance motor 73 (see FIG. 1) to the feed roller 25. As a result, the feed roller 25 rotates forward and feeds the uppermost sheet 12 supported by the bottom wall 22 to the conveyance path 65. A downward force is applied to the tip end of the feed arm 26 due to the weight of the feed arm 26 or the urging force of a spring and so on. Thus, the feed roller 25 presses the sheet 12 on the bottom wall 22 downward.

As shown in FIG. 3, the conveyance path 65 is defined in the internal space of the housing 14. The conveyance path 65 has a so-called U-turn shape. The conveyance path 65 extends upward from the rear end of the supply tray 20 at the mount position and curves toward the front. The curved portion of the conveyance path 65 is defined by an outer guide member 18 and an inner guide member 19. The conveyance path 65 extends substantially linearly forward from the outer guide member 18 and the inner guide member 19, and reaches the rear end of the discharge tray 21. The straight portion of the conveyance path 65 is defined by the lower surface of a head 39 and the upper surface of the platen 42. The sheet 12 is conveyed in a conveyance direction 15 indicated by the single-dot chain line along the conveyance path 65.

[Conveyance Roller Pair 54]

As shown in FIG. 3, the conveyance roller pair 54 (an example of a conveyor) is located forward of the outer guide member 18 and the inner guide member 19 in the conveyance path 65. The conveyance roller pair 54 has a conveyance roller 60 and a pinch roller 61. The conveyance roller 60 is a cylindrical roller of which the axial direction is in the left-right direction 9. The conveyance roller 60 rotates by receiving the rotation of a conveyance motor 102 (see FIG. 1). The plurality of pinch rollers 61 are arranged side by side in the left-right direction 9. Each pinch roller 61 has an axial direction substantially in the left-right direction 9. The pinch roller 61 is urged toward the conveyance roller 60 by a spring. When a sheet enters between the conveyance roller 60 and the pinch roller 61, the pinch roller 61 separates from the conveyance roller 60 by the thickness of the sheet.

[Discharge Roller Pair 55]

As shown in FIG. 3, the discharge roller pair 55 (an example of the conveyor) is located forward of the recording unit 24 in the conveyance path 65. The discharge roller pair 55 has a discharge roller 62 and a spur 63. The discharge roller 62 is a cylindrical roller of which the axial direction is in the left-right direction 9. The discharge roller 62 rotates by receiving the rotation of the conveyance motor 102 (see FIG. 1). The discharge roller 62 may be one roller or a plurality of rollers arranged in the left-right direction 9. The plurality of spurs 63 are arranged side by side in the left-right direction 9. Each spur 63 has an axial direction in the left-right direction 9. The spur 63 is urged toward the discharge roller 62 by a spring. When a sheet enters between the discharge roller 62 and the spur 63, the spur 63 separates from the discharge roller 62 by the thickness of the sheet.

[Recording Unit 24]

As shown in FIG. 3, the recording unit 24 is located between the conveyance roller pair 54 and the discharge roller pair 55 in the conveyance path 65. The recording unit 24 includes a carriage 23 and the head 39.

Figure 4:
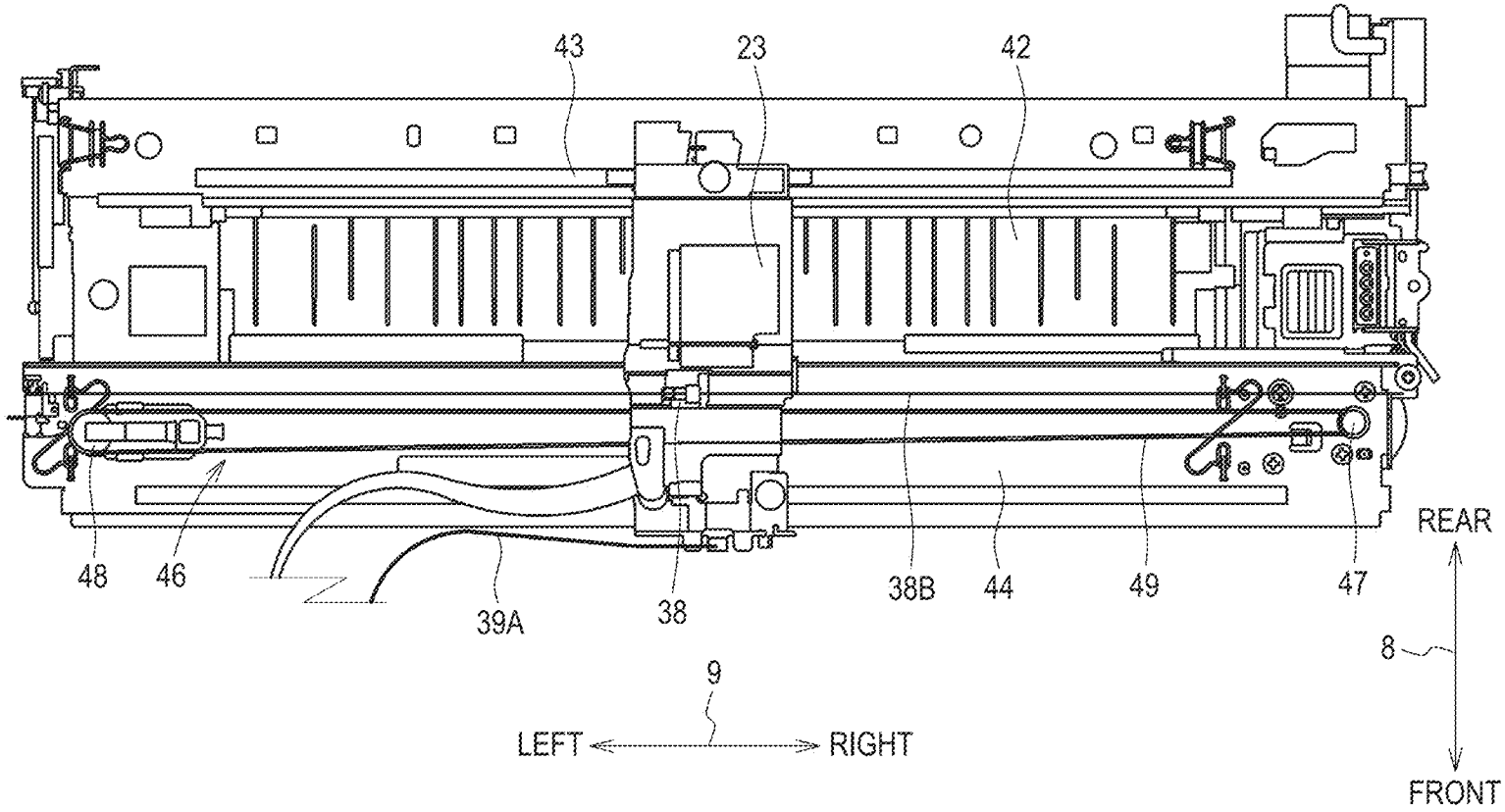
FIG. 4 is a plan view of a carriage 23 and guide rails 43 and 44.

As shown in FIG. 4, the carriage 23 is supported by guide rails 43 and 44. The guide rails 43 and 44 are separated from each other in the front-rear direction 8, and each extends in the left-right direction 9. The carriage 23 is located between the guide rails 43 and 44, and the front end and the rear end are supported by the guide rails 43 and 44, respectively. The guide rail 44 is provided with a belt drive mechanism 46.

The belt conveyance mechanism 46 has two pulleys 47 and 48 and a belt 49. The two pulleys 47 and 48 are located apart from each other in the left-right direction 9 on the guide rail 44. The belt 49 is stretched on the two pulleys 47 and 48. The carriage 23 is connected to the belt 49. The rotation of the carriage motor 103 (see FIG. 1) is transmitted to the pulley 47. When the pulley 47 rotates, the belt 49 circularly moves and the carriage 23 moves in the left-right direction 9 (an example of a scanning direction).

An encoder strip 38B extending in the left-right direction 9 is located at the guide rail 44. The carriage 23 is provided with a carriage sensor 38. The carriage sensor 38 is an optical sensor having a light emitting element and a light receiving element. A plurality of light-transmitting portions and a plurality of light-blocking portions are alternately located on the encoder strip 38B along the left-right direction 9. When the carriage 23 reciprocates, the carriage sensor 38 emits light from the light emitting element toward the encoder strip 38B, and receives the light which has transmitted the encoder strip 38B by the light receiving element. The carriage sensor 38 outputs an electric signal corresponding to the amount of received light to the controller 130. The controller 130 determines the position and the moving speed of the carriage 23 in the left-right direction 9, based on the electric signal output by the carriage sensor 38.

As shown in FIG. 3, the head 39 is mounted on the carriage 23. The head 39 faces the platen 42. A plurality of nozzle openings 40, which are openings of the plurality of nozzles, are formed on the lower surface of the head 39. The nozzle openings 40 are arranged in a row in the front-rear direction 8 for each color of ink. Thus, in the configuration in which the head 39 ejects four colors of ink, the four rows of the nozzle openings 40 are located apart from each other in the left-right direction 9.

In the head 39, ink droplets that flow in the nozzle are ejected from each nozzle opening 40 due to vibration of a piezo element. Ink of each color is supplied to the head 39 from an ink container (not shown) through an ink tube 39A. In the process in which the carriage 23 moves either leftward or rightward, ink droplets are ejected from each nozzle opening 40 based on image recording data, and the ink droplets adhere to the sheet 12 to record an image. The unit in which the carriage 23 moves once either leftward or rightward while ink droplets are ejected from the nozzle openings 40 of the head 39 to record an image is referred to as "one pass".

The platen 42 is located between the conveyance roller pair 54 and the discharge rollers pair 55. The upper surface of the platen 42 is a support surface 42A that supports the sheet 12. The support surface 42A extends over almost the entire movement range of the carriage 23 in the left-right direction 9.

[Registration Sensor 120]

As shown in FIG. 3, a registration sensor 120 is located rearward of the conveyance roller pair 54 in the conveyance path 65. The registration sensor 120 includes a sensor arm 120A that is supported by the inner guide member 19 and extends to the conveyance path 65. The sensor arm 120A is rotatable so as to appear in the conveyance path 65. An optical sensor 120B detects the rotational position of the sensor arm 120A. When the sheet 12 conveyed along the conveyance path 65 contacts the sensor arm 120A, the sensor arm 120A rotationally moves so as to retract from the conveyance path 65. The optical sensor 120B detects the rotated sensor arm 120A and outputs an electric signal to the controller 130. The controller 130 determines whether the sheet 12 is present at the position of the sensor arm 120A, based on the electric signal output by the registration sensor 120.

[Rotary Encoder 121]

As shown in FIG. 3, the conveyance roller 60 is provided with a rotary encoder 121 (see FIG. 1). The rotary encoder 121 includes an encoder disk 121A and an optical sensor 121B. The encoder disk 121A is coaxially attached to the conveyance roller 60 and rotates together with the conveyance roller 60. In the encoder disk 121A, a plurality of light-transmitting portions and a plurality of light-blocking portions are alternately arranged in the circumferential direction. The optical sensor 121B emits light from the light emitting element toward the rotating encoder disk 121A, and the light receiving element receives the light which has transmitted the encoder disk 121A. As shown in FIG. 1, the optical sensor 121B outputs an electric signal corresponding to the amount of received light to the controller 130. The controller 130 determines the number of rotations and the rotation speed of the conveyance roller 60 based on the electric signal output from the rotary encoder 121.

[Controller 130]

As shown in FIG. 1, the controller 130 includes a CPU 131, a ROM 132, a RAM 133, an EEPROM 134, and an ASIC 135, which are connected by an internal bus 137. The ROM 132 stores a program and so on for controlling the operation of the MFP 10. The CPU 131 executes the program while reading the same out from the RAM 133 and the EEPROM 134.

The ASIC 135 is electrically connected to the conveyance motor 102 and the carriage motor 103. The ASIC 35 generates drive signals for rotating the conveyance motor 102 and the carriage motor 103, and outputs the drive signals to the conveyance motor 102 and the carriage motor 103, respectively. The ASIC 135 is electrically connected to the registration sensor 120, the rotary encoder 121, and the carriage sensor 38, and receives electrical signals from these components.

As shown in FIG. 1, the MFP 10 includes a communication interface (hereinafter, also referred to as "communication IF") 111. The communication IF 111 is an interface for performing data communication with the information processing apparatus 150 through the data transmission line 160.

[Information Processing Apparatus 150]

As shown in FIG. 1, the information processing apparatus 150 is, for example, a PC, a smartphone, or a tablet terminal, and includes a controller 151, a user interface (hereinafter, also referred to as "user IF") 152, and a communication IF 153. The controller 151 includes a CPU, a ROM, a RAM, and so on. The user IF152 includes a display, a mouse, and so on. The display is a liquid crystal display, an organic EL display, and so on, and displays various information. The mouse accepts an input by the user.

The controller 151, the user IF 152, and the communication IF 153 are connected to each other by the internal bus 154 so as to perform communication. Since the configurations of the controller 151, the communication IF 153, and the internal bus 154 are the same as those of the controller 130, the communication IF 111, and the internal bus 137 included in the MFP 10, their descriptions are omitted.

[Operations of System 1]

Hereinafter, processing in which the MFP 10 records an image on the sheet 12 based on a recording instruction output from the information processing apparatus 150 will be described.

[Processing of Information Processing Apparatus 150]

Figure 5:
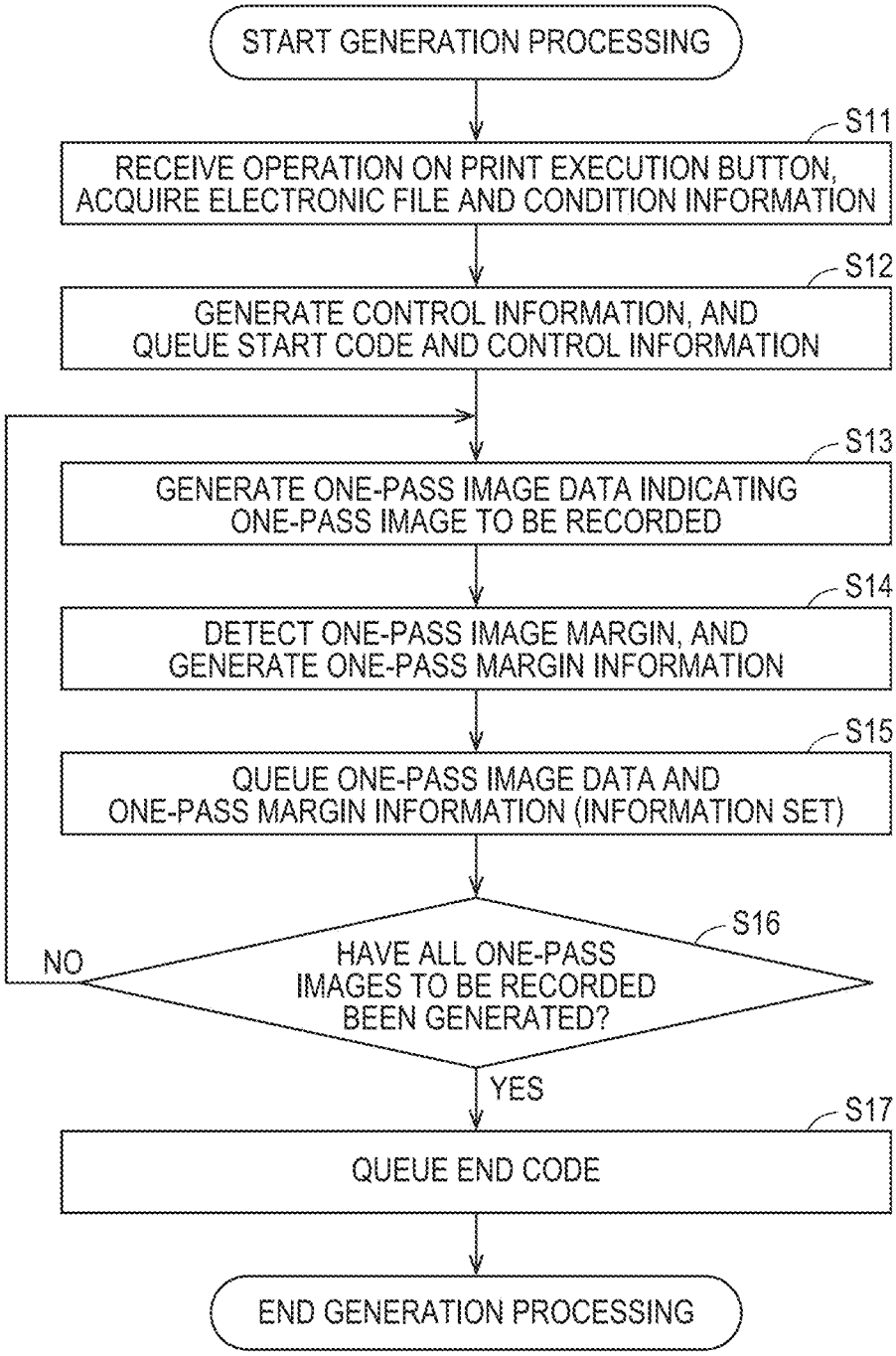
FIG. 5 is a flowchart showing generation processing.
Figure 6:
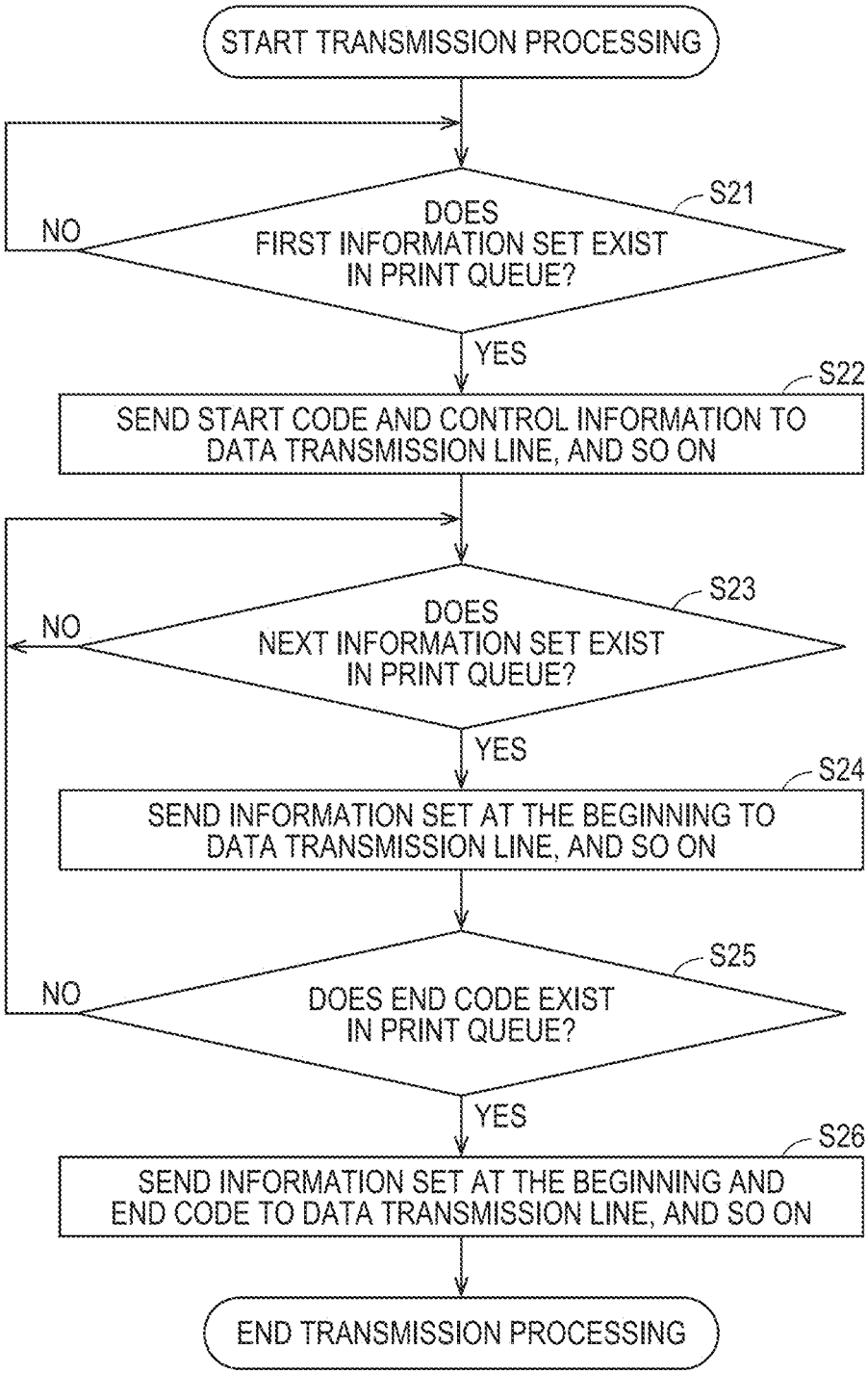
FIG. 6 is a flowchart showing transmission processing.

With reference to FIGS. 5 and 6, the processing by the information processing apparatus 150 is described.

The controller 151 starts generation processing of recording instruction information shown in FIG. 5 by executing a program stored in the ROM. The controller 151 receives an operation of a print execution button displayed on the display and acquires an electronic file and condition information (S11 of FIG. 5).

The electronic file includes one or a plurality of image recording data. Each image recording data represents an image to be recorded. Each image to be recorded is an image to be recorded on a recording surface of the sheet 12 in the MFP 10. Each image to be recorded includes values of a plurality of pixels arranged in a matrix shape in a first direction 15A and a second direction 9A (see FIG. 9). The value of the pixel represents the color of the pixel. The first direction 15A is a direction from the leading end to the trailing end of the sheet 12 and parallel to the conveyance direction 15. The second direction 9A is a direction perpendicular to the first direction 15A.

When the electronic file includes a plurality of image recording data, the electronic file further includes recording order information corresponding to each image to be recorded. Each recording order information represents a recording order, which is an order of the corresponding images to be recorded on the sheet 12. The recording order is a page number and so on. In this embodiment, the electronic file includes one image recording data.

[Generation Processing]

Triggered by the execution of S11, the controller 151 performs S12 and the subsequent steps. The recording instruction information is a so-called print job and represents an instruction for instructing the MFP 10 to record the image to be recorded on the sheet 12.

In S12, the controller 151 generates control information. The control information includes identification information and the number of one-pass images for each image to be recorded. The control information further includes the condition information acquired in S11.

The identification information is information for identifying the corresponding image to be recorded and is, for example, a combination of the name of the electronic file (that is, file name) and the recording order information. The identification information may be a print job name instead of the file name.

Figure 9:
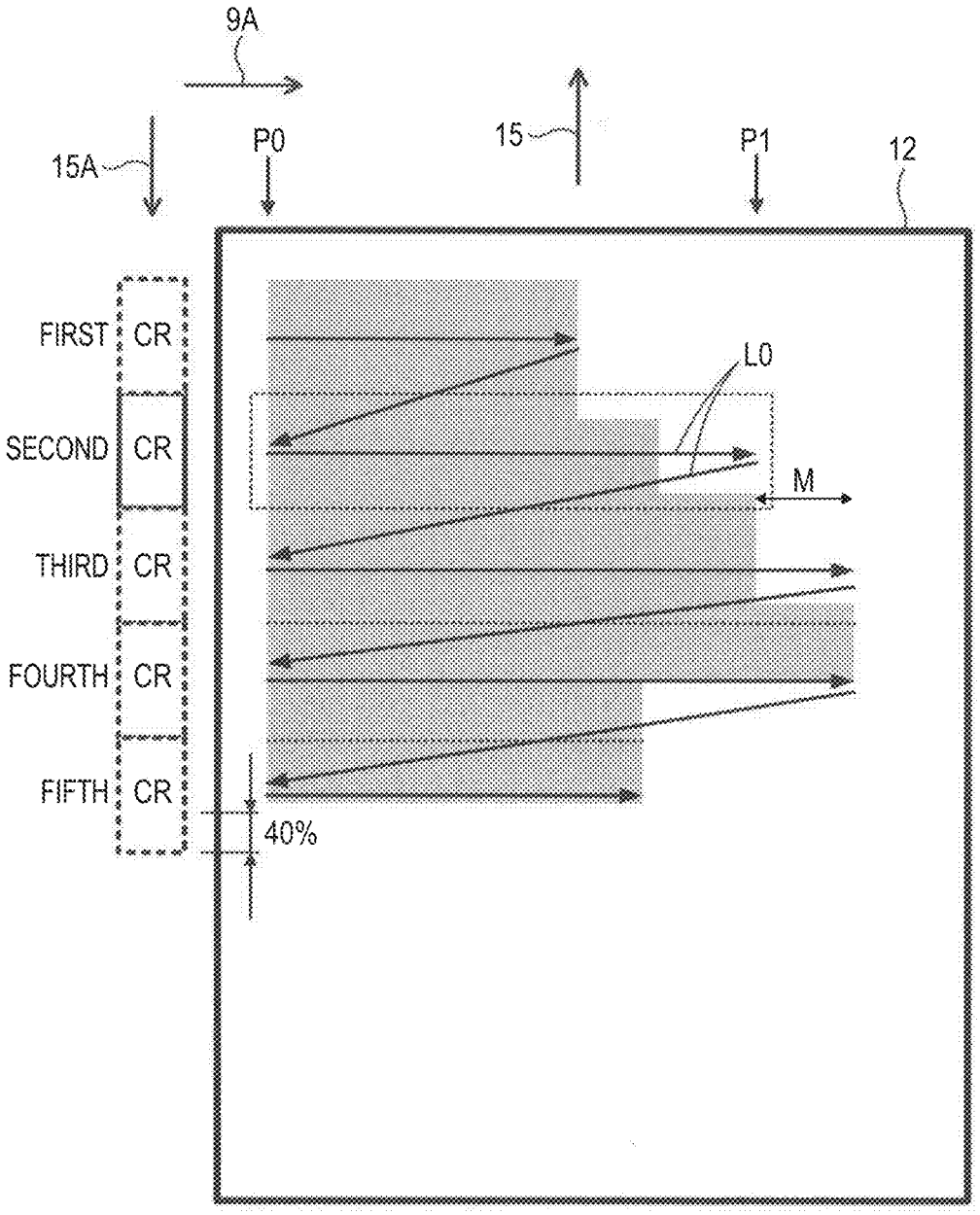
FIG. 9 is a schematic view showing a length L0 of a second pass image in the pass adjustment processing.

The number of one-pass images is information representing the number of one-pass images constituting the corresponding image to be recorded. Each one-pass image is an image obtained by dividing the image to be recorded in the first direction 15A (see FIG. 9 and so on). The sizes of each one-pass image in the first direction 15A and the second direction 9A (see FIG. 9 and so on) define a region to be recorded by one pass. Each one-pass image is recorded on the sheet 12 conveyed in the conveyance direction 15 in the order indicated by the first direction 15A. As a result, each one-pass image is recorded in a corresponding region on the sheet 12. FIG. 9 shows an example in which the image to be recorded is divided into five one-pass images.

The controller 151 derives the number of one-pass images, for example, by dividing the size of an image recording region on the sheet 12 of a sheet size included in the recording condition by the size of one pass.

In S12, the controller 151 queues a start code of the recording instruction information and the control information in a print queue. The print queue is a storage region secured in the RAM.

In S13, the controller 151 sequentially generates a plurality of one-pass image recording data (partial image data) representing a plurality of one-pass images with respect to the acquired image to be recorded.

Each one-pass image recording data has a bitmap format and so on. In each one-pass image recording data, the value of each pixel is indicated by a YMCK value. The image recording data may be in a bitmap format or in another format (for example, JPEG format). In the case of another format, in S13, the one-pass image recording data is generated after the image recording data is converted into the bitmap format. Since the value of each pixel is indicated by an RGB value in the image recording data, the value of each pixel is converted from the RGB value into the YMCK value in S13.

Every time the generation of one one-pass image recording data is finished in S13, in S14 the controller 151 detects a one-pass image margin (partial image margin) with respect to the one-pass image represented by the generated one-pass image recording data. In S14, the controller 151 further generates one-pass margin information (partial margin information) representing the size of the detected one-pass image margin.

A method for detecting the one-pass image margin in S14 is, for example, as follows. The controller 151 counts the number of the pixels from the pixel on one end in the second direction 9A until the pixel having a value other than white first appears in the second direction 9A for each of pixel rows arranged in the second direction 9A in the target one-pass image. The controller 151 also counts the number of the pixels from the pixel on the other end in the second direction 9A until the pixel having a value other than white first appears in a direction opposite to the second direction 9A. The controller 151 generates the one-pass margin information representing a minimum number of pixels, out of the counted number of pixels, as the size of the one-pass image margin. In other words, the one-pass image margins may exist at one end and the other end in the one-pass image. The size of the one-pass image margin is the minimum value of the margin of the one-pass image margin in the second direction 9A. For example, the size of the one-pass image margin of the second one-pass image in FIG. 9 is indicated as "M".

In S15, the controller 151 queues an information set in the print queue. The information set is a combination of the one-pass image recording data generated in S13 and the one-pass margin information generated in S14.

In S16, the controller 151 determines whether the generation of all the one-pass images to be recorded from the target image has been completed. In response to determining that the generation has not yet been completed (S16: No), the controller 151 returns to S13. In response to determining that the generation has been completed (S16: Yes), in S17 the controller 151 queues an end code of the recording instruction information in the print queue and ends the generation processing.

[Transmission Processing]

The controller 151 performs transmission processing shown in FIG. 6 in parallel with the generation processing. The transmission processing includes S21 to S26.

The controller 151 periodically performs S21 after the start of the generation processing. In S21, the controller 151 determines whether a first information set exists in the print queue. In response to determining that no first information set exits in the print queue (S21: No), the controller 151 returns to S21 and waits for the next execution timing. In response to determining that a first information set exists in the print queue (S21: Yes), the controller 151 sequentially transfers the start code and the control information from the print queue to the communication IF 153 in a FIFO (First In First Out) manner and, thereafter, deletes the start code and the control information from the print queue. The communication IF 153 sends out the received start code and control information to the data transmission line 160.

In the following description, the processing such as S22, that is, a series of processing "the controller 151 transfers the information from the print queue to the communication IF 153 in a FIFO manner and deletes the transferred information and the communication IF 153 sends out the received information to the data transmission line 160" is described in a simplified manner as "the controller 151 sends out the information at the beginning of the print queue to the data transmission line 160".

After S22, the controller 151 periodically performs S23. In S23, the controller 151 determines whether the next information set exists in the print queue. In response to determining that no next information set exists in the print queue (S23: No), the controller 151 returns to S23 and waits for the next execution timing. In response to determining that the next information set exists in the print queue (S23: Yes), in S24 the controller 151 sends out the information set at the beginning of the print queue to the data transmission line 160.

After S24, the controller 151 periodically performs S25. In S25, the controller 151 determines whether an end code exists in the print queue. In response to determining that no end code exits in the print queue (S25: No), the controller 151 returns to S23 and waits for the next execution timing. In response to determining that an end code exists in the print queue (S25: Yes), in S26 the controller 151 sequentially sends out the information set at the beginning of the print queue and the end code to the data transmission line 160 and ends the transmission processing. As a result of the transmission process, the recording instruction information including the start code, the control information, the plurality of information sets, and the end code is sequentially transmitted to the MFP 10.

[Image Recording Processing of MFP 10]

Next, the processing by the MFP 10 will be described with reference to FIGS. 7 to 11.

Figure 7:
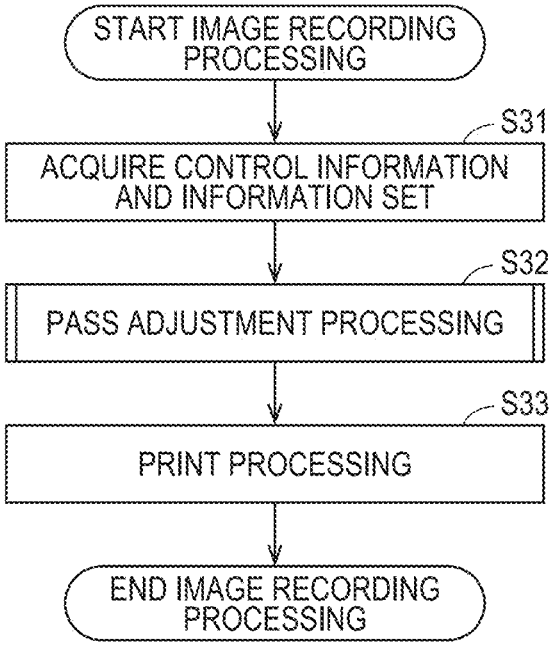
FIG. 7 is a flowchart showing image recording processing.

The controller 130 executes the program stored in the ROM 132 and performs image recording processing in S31 and thereafter shown in FIG. 7, triggered by the reception of the start code included in the recording instruction information.

In S31, the controller 130 sequentially acquires the control information and the information sets. In particular, the controller 130 sequentially transfers the start code, the control information, the information sets, and the end code sequentially received by the communication IF 111 to the RAM 133, and the RAM 133 stores these information. The image to be recorded is stored in the RAM 133. Each one-pass image constituting the image to be recorded is stored in the RAM 133 in the order indicated by the first direction 15A.

In S32, the controller 130 performs pass adjustment processing based on the control information and the information sets acquired in S31.

Figure 8:
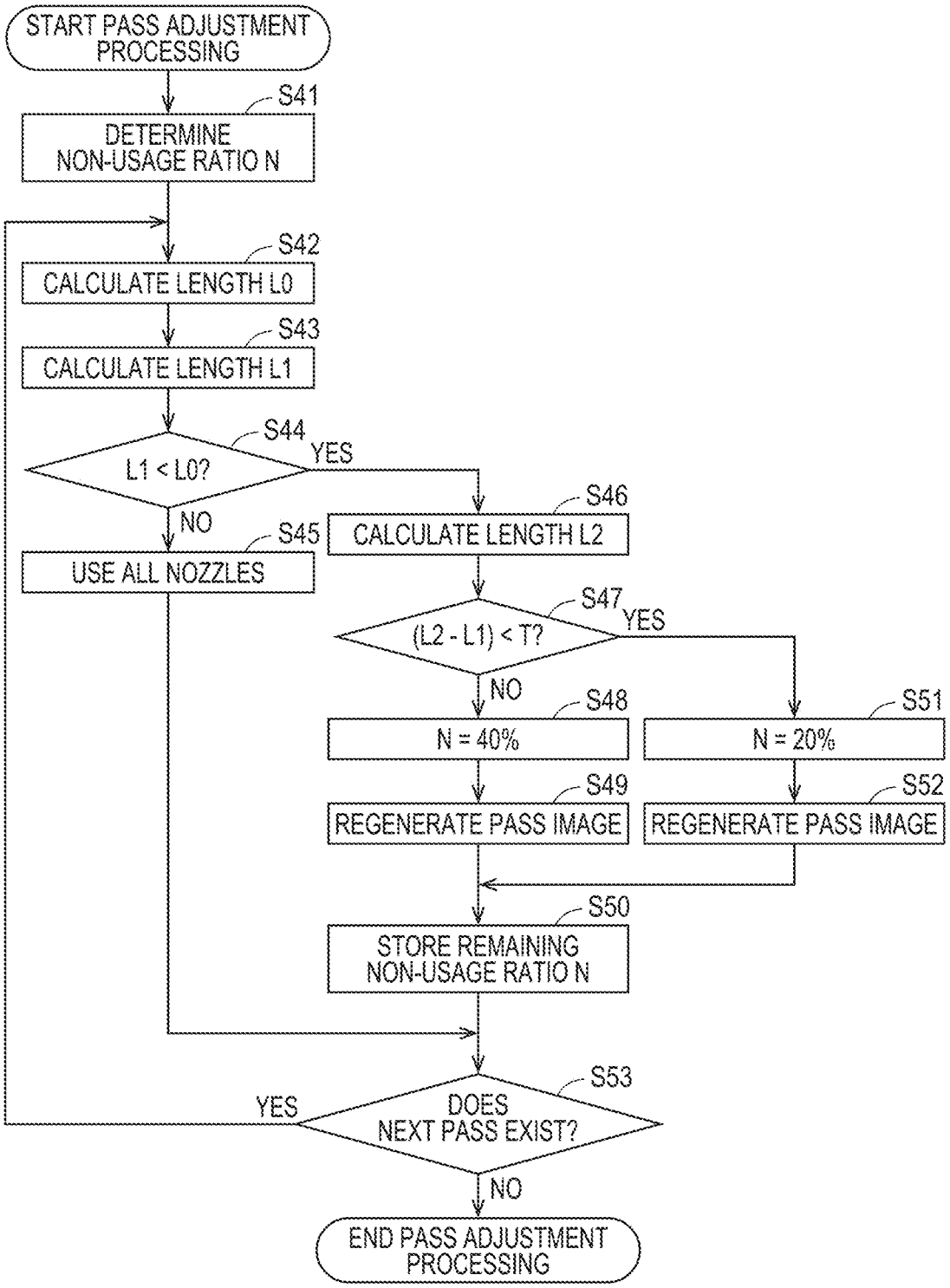
FIG. 8 is a flowchart showing pass adjustment processing.

As shown in FIG. 8, in S41, the controller 130 determines a non-usage ratio N of the nozzles 40 of the head 39 in the last pass based on the acquired control information. For example, for an image of FIG. 9, 40 percent (N=40%) is determined as the non-usage ratio N of the fifth pass image, which is the last pass image. The controller 130 then stores the determined non-usage ratio N in the RAM 133.

Figure 10:
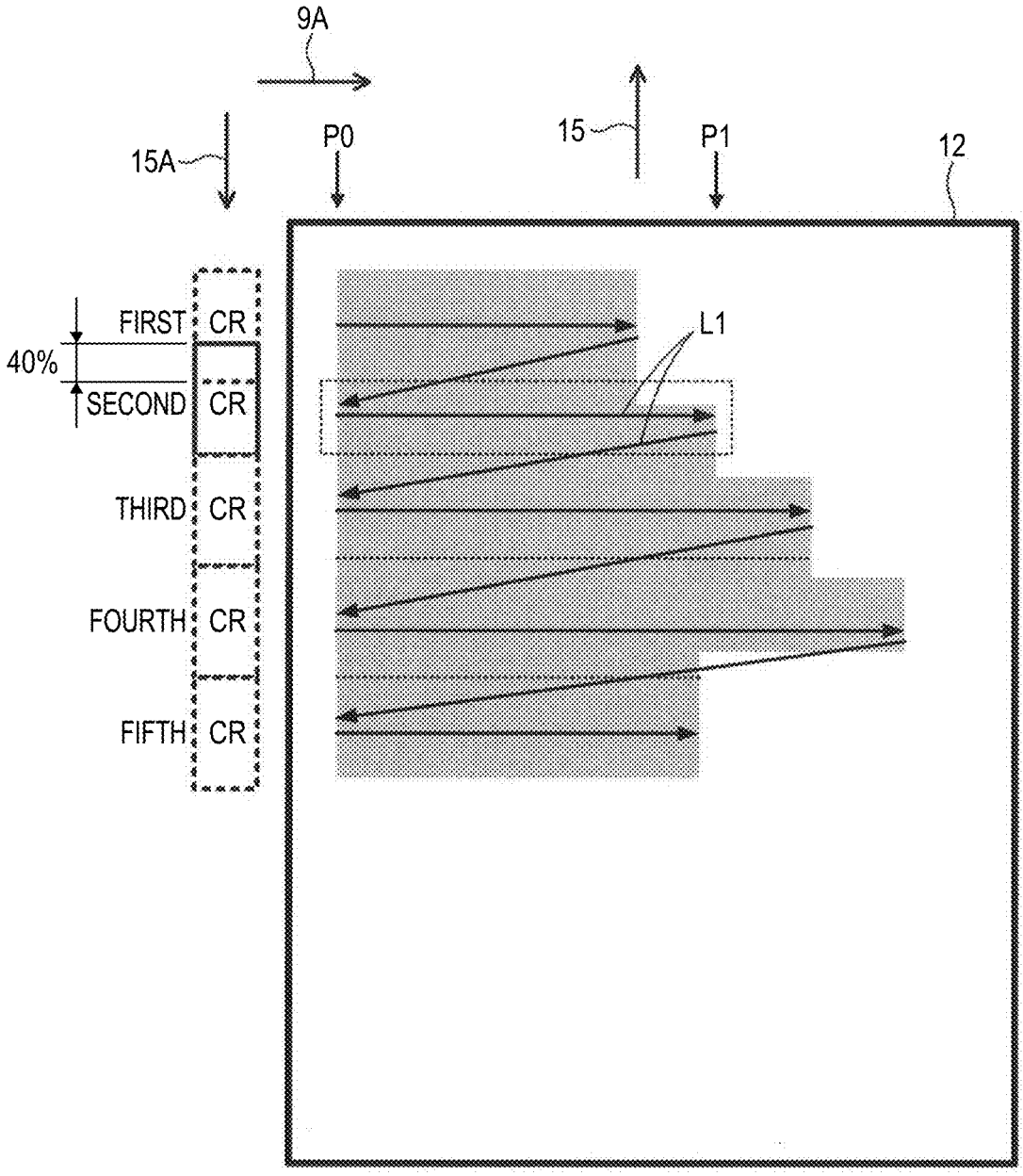
FIG. 10 is a schematic view showing a length L1 of the second pass image in the pass adjustment processing.
Figure 11:
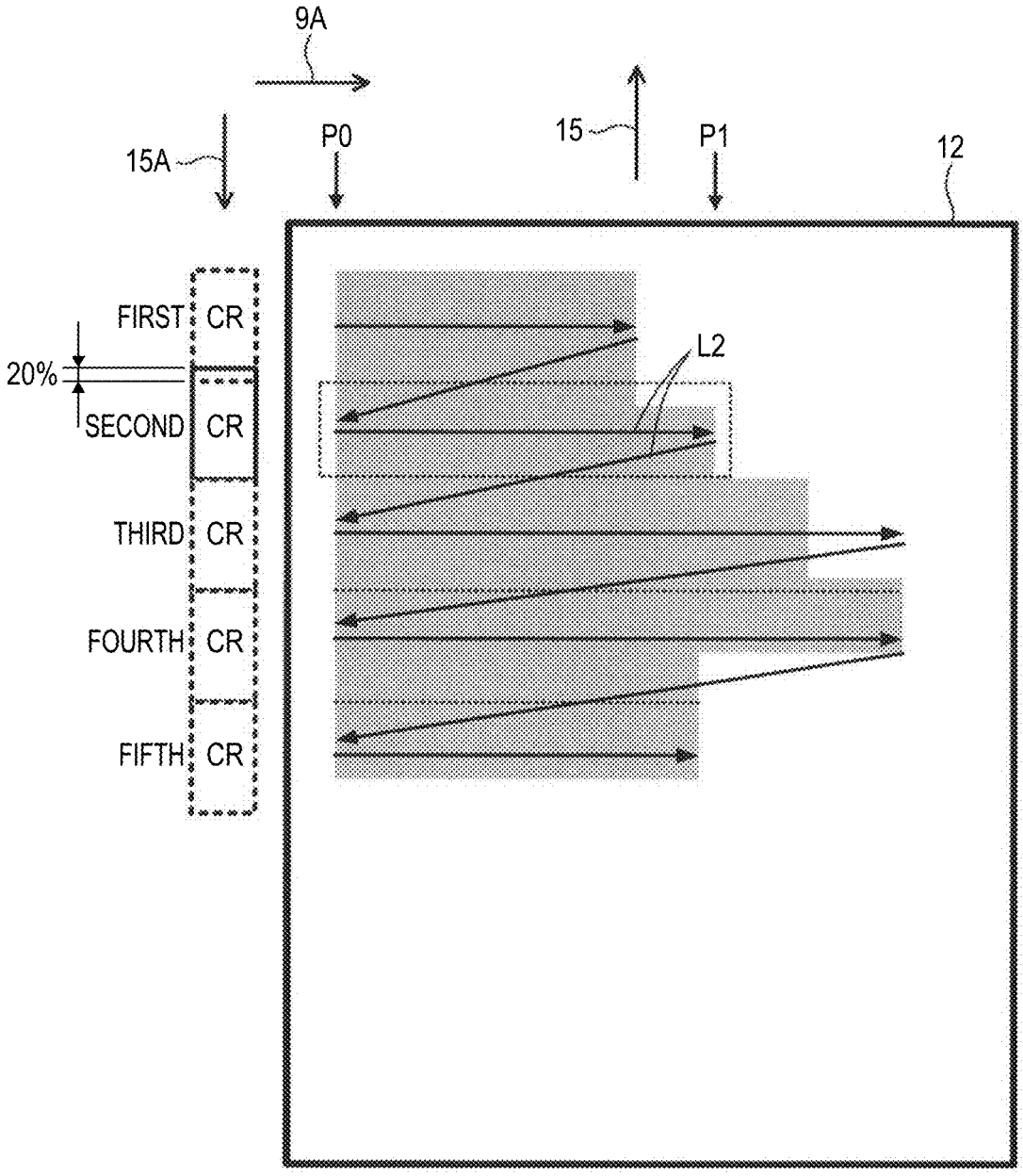
FIG. 11 is a schematic view showing a length L2 of the second pass image in the pass adjustment processing.

In FIGS. 9 to 11, the regions where the image is recorded by ejecting ink from the nozzles 40 of the head 39 are painted in gray. In FIGS. 9 to 11, a rectangular frame shown to the left of the sheet 12 and filled in with the letter "CR" represents the position of the carriage 23 in the corresponding pass. A state where the rectangular frames of the carriage 23 do not vertically overlap indicates that all the nozzles 40 are used for image recording in each pass (see FIG. 9). A state where the rectangular frames of the carriage 23 vertically overlap indicates that the nozzles 40 located in an upper part of the lower frame, out of the overlapping frames, are not used.

The non-usage ratio N is a ratio of the number of the nozzles 40 that are not used in the last pass (fifth pass in this embodiment) to the total number of the nozzles 40 arranged in the front-rear direction 8 in the head 39. For example, the non-usage ratio N is calculated by subtracting, from 100 percent, a ratio of the length of the last pass in the first direction 15A to the length of each pass (in which all the nozzles 40 arranged in the front-rear direction 8 are used) other than the last pass in the first direction 15A. In FIG. 9, since 40 percent of the nozzles 40 arranged continuously from the most upstream side toward the downstream side in the conveyance direction 15 are not used in the fifth pass image (the last pass image), the non-usage ratio N is 40 percent (N=40%, an example of a first ratio).

In S42, the controller 130 calculates a length L0 (an example of a first movement distance) by which the carriage 23 moves in the left-right direction 9 in the kth pass image. Successive natural numbers are sequentially given to the passes from the one located at the downstream side in the conveyance direction 15, and the kth pass image is an image in the kth pass. The leading pass image is the first pass image (k=1). Since all the nozzles 40 arranged in the front-rear direction 8 are used in the kth pass image, which is not the last pass image, a length of the kth pass image in the first direction 15A is the maximum length.

The length L0 differs depending on the one-pass margin information of the kth pass image. The carriage 23 moves in the second direction 9A from a movement start position P0 in each pass. The carriage 23 decelerates and stops after finishing the image recording at an image recording end position in the kth pass image. That is, when the carriage 23 reaches a margin at the downstream side in the second direction 9A, ink ejection from the nozzles 40 is finished and the carriage 23 moving at a constant speed decelerates and stops at a movement stop position P1. Then, the carriage 23 returns to the movement start position P0 of the (k+1)th pass image. The length L0 is a length starting from the position P0 by way of the movement stop position P1 and returning to the position P0 along the left-right direction 9. That is, the length L0 is the sum of a distance from the movement start position (the position P0) to the movement stop position (the position P1) of one pass and a distance from the movement stop position (the position P1) of the one pass to the movement start position (the position P0) of the next pass. Although the position P0 is fixed in this embodiment, the position P0 may be changed according to the image recording position of the kth pass image. In FIG. 9, the position P1 in the second pass image is shown.

In S43, the controller 130 calculates a length L1 (an example of a second movement distance) of one pass assuming that the nozzles 40 of the non-usage ratio N are not used in the kth pass image (in other words, assuming that the width of the kth pass image in the conveyance direction 15 is reduced by the non-usage ratio N). Since 40 percent is stored as the non-usage ratio N in the RAM 133, the controller 130 temporarily generates the kth pass image without using 40 percent of the nozzles 40 at the upstream side in the first direction 15A (at the downstream side in the conveyance direction 15) in the kth pass image.

In S44, the controller 130 determines whether the length L1 is shorter than the length L0 in the kth pass image (L1<L0?).

For example, the length L1 is equal to the length L0 (S44: No) in the first pass image. If the length L1 is not shorter than the length L0 as in the first pass image, in S45 the controller 130 stores, in the RAM 133, the first pass image using all the nozzles 40 as the pass for image recording.

For example, as shown in FIG. 10, the length L1 is shorter than the length L0 (S44: Yes) in the second pass image. If the length L1 is shorter than the length L0 as in the second pass image, in S46 the controller 130 calculates a length L2 (an example of a third movement distance) of the one-pass image assuming that the nozzles 40 of half the non-usage ratio N (N/2) are not used in the second pass image. Since 40 percent is stored as the non-usage ratio N in the RAM 133, the controller 130 temporarily generates the second pass image without using the nozzles 40 of 20 percent (an example of a second ratio) at the upstream side in the first direction 15A, for example, in the second pass image.

In S47, the controller 130 determines whether a difference between the lengths L2 and L1 is shorter than a threshold value T ((L2−L1)<T?) in the kth pass image. If the difference is not shorter than the threshold value T (S47: No), in S48 the controller 130 stores, in the RAM 133, the pass not using the nozzles 40 of the non-usage ratio N (here 40 percent) as the kth pass image for image recording. The relationship that the difference between the lengths L2 and L1 is not shorter than the threshold value T means that the movement distance of the carriage 23 can be made considerably shorter when the kth pass image is recorded at the non-usage ratio N than when the kth pass image is recorded at the non-usage ratio N/2.

In S49, the controller 130 regenerates all the pass images subsequent to the (k+1)th pass image by using all the nozzles, and stores the regenerated pass images in the RAM 133. In S50, the controller 130 sets the remaining non-usage ratio N to zero and stores the same in the RAM 133.

For example, as shown in FIGS. 10 and 11, the lengths L2 and L1 are equal in the second pass image. Thus, the difference between the lengths L2 and L1 is shorter than the threshold value T (S47: Yes). If the difference between the lengths L2 and L1 is shorter than the threshold value T as in the second pass image, in S51 the controller 130 stores, in the RAM 133, the second pass image for image recording without using the nozzles 40 of the non-usage ratio N/2 (here 20 percent). The relationship that the difference between the lengths L2 and L1 is shorter than the threshold value T means that the movement distance of the carriage 23 does not change very much regardless of whether the kth pass image is recorded at the non-usage ratio N/2 or the kth pass image is recorded at the non-usage ratio N.

In S52, the controller 130 regenerates all the pass images subsequent to the (k+1)th pass image by using all the nozzles. In S50, the controller 130 sets the remaining non-usage ratio N to N/2 (an example of a third ratio) and stores the same in the RAM 133.

In S53, the controller 130 determines whether the next pass image exists, that is, whether the (k+1)th pass image exists. If the next pass image exists (S53: Yes), the controller 130 returns to S42. In S43 after the return, the controller 130 calculates the length L1 of the (k+1)th pass image assuming that the nozzles 40 of the non-usage ratio N/2 are not used. This length L1 is an example of a fourth movement distance.

Figure 12:
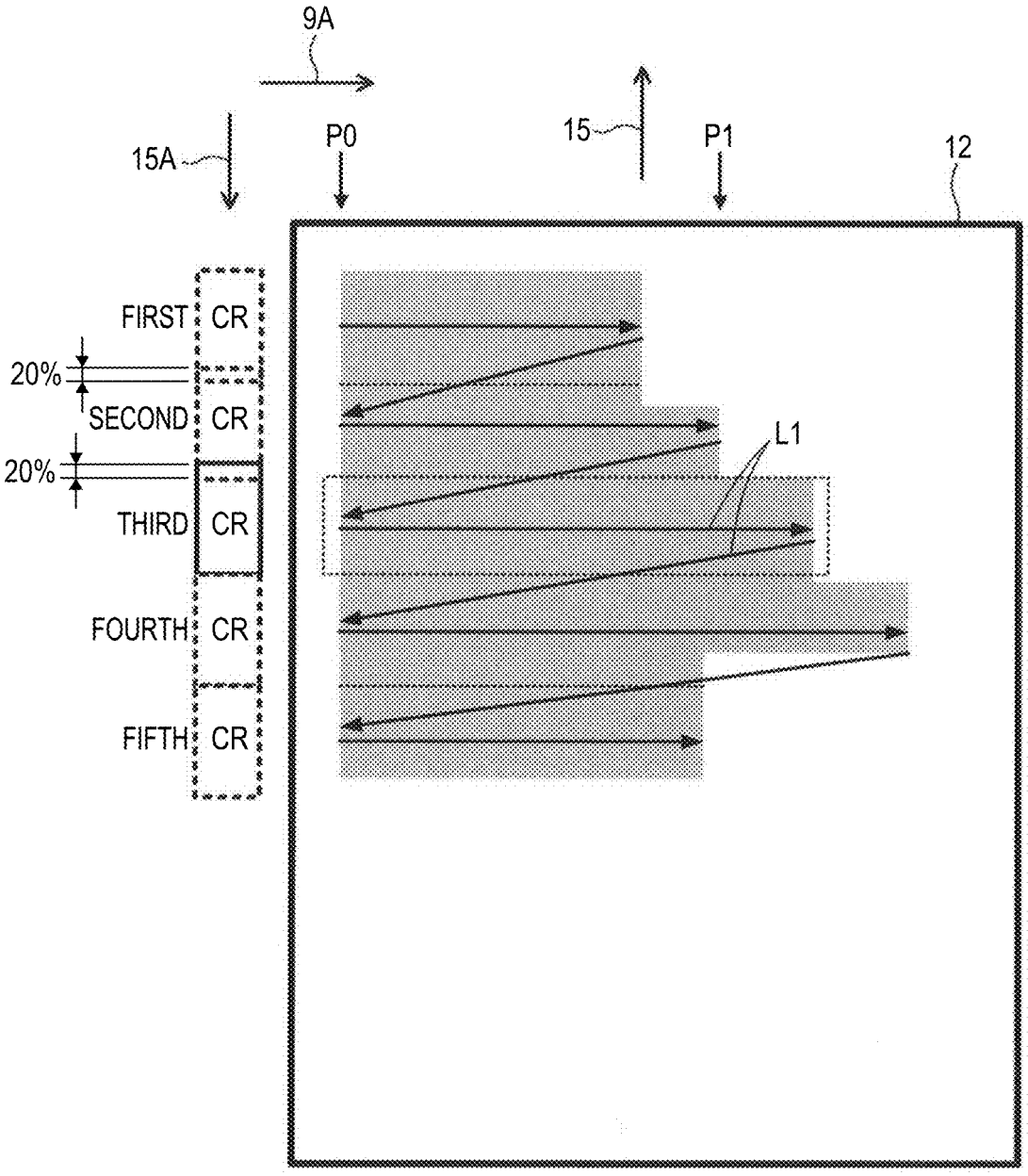
FIG. 12 is a schematic view showing a length L1 of a third pass image in the pass adjustment processing.

For example, as shown in FIG. 12, the length L1 is shorter than the length L0 (S44: Yes) in the third pass image. If the length L1 is shorter than the length L0 as in the third pass image, in S46 the controller 130 calculates the length L2 of the second pass image assuming that the nozzles 40 of half the non-usage ratio N are not used. Since 20 percent is stored as the non-usage ratio N in the RAM 133, the controller 130 temporarily generates the second pass image without using the nozzles 40 of 10 percent (half of 20 percent) at the upstream side in the first direction 15A, for example, in the third pass image. Since the difference between the lengths L2 and L1 is not shorter than the threshold value T (S47: No) in FIG. 12, the non-usage ratio N is set to 20 percent. In S50, the controller 130 sets the remaining non-usage ratio N to zero, and stores the same in the RAM 133. If no next pass image exists (S53: No), the controller 130 ends the pass adjustment processing.

As shown in FIG. 7, when the pass adjustment processing ends, the controller 130 performs print processing in which the recording unit 24 ejects ink to the sheet 12. In the print processing, the controller 130 repeatedly performs the image recording of one pass on the sheet 12 by ejecting ink from the nozzles 40 of the head 39 while moving the carriage 23 in the second direction 9A based on each pass image stored in the RAM 133, conveys the sheet 12 in the conveyance direction 15 after performing the image recording of one pass, and performs the image recording of the next pass.

Operations and Effects of the Embodiment

According to the embodiment, the movement distance of the carriage 23 can be shortened without using a part of the nozzles 40 in each pass image, the part of the nozzles 40 being less than or equal to the ratio of continuous nozzles 40 that do not eject ink from the most upstream nozzle toward downstream in the conveyance direction 15 in the last pass image in image recording based on image recording data. Thus, without increasing the number of passes required for image recording, the movement distance of the carriage 23 can be shortened to reduce the time required for image recording.

Further, by dividing and allocating the non-ejection ratio N of the nozzles not used in the last pass image to a plurality of pass images without applying all of the non-usage ratio N to one pass, the movement distance of the carriage 23 can be shortened.

Modification

While the disclosure has been described in detail with reference to the above aspects thereof, it would be apparent to those skilled in the art that various changes and modifications may be made therein without departing from the scope of the claims.

In the above-described embodiment, the non-ejection ratio N is divided into two, but the non-ejection ratio N may be divided into three or more, or the non-ejection ratio N may not be divided. For example, in a case where the non-ejection ratio N is used without being divided, when the length L1 is shorter than the length L0 in the second pass image, the image recording of the second pass image is performed without using the nozzles 40 of the non-ejection ratio N, that is, 40 percent (that is, the non-ejection ratio N is not divided). Then, for the subsequent pass images, that is, the third pass image and thereafter, image recording of each pass image is performed by using all the nozzles 40 without calculating the length L1.

Further, in the above-described embodiment, the carriage 23 moves only in the second direction 9A in the image recording. However, the controller 130 may perform image recording by ejecting ink from the nozzles 40 while moving the carriage 23 in two directions, that is, in the second direction 9A and a third direction 9B opposite the second direction 9A. In this case, the movement start position P0 is not fixed, and the movement start position P0 differs depending on the margin in the next pass image.

Figure 13:
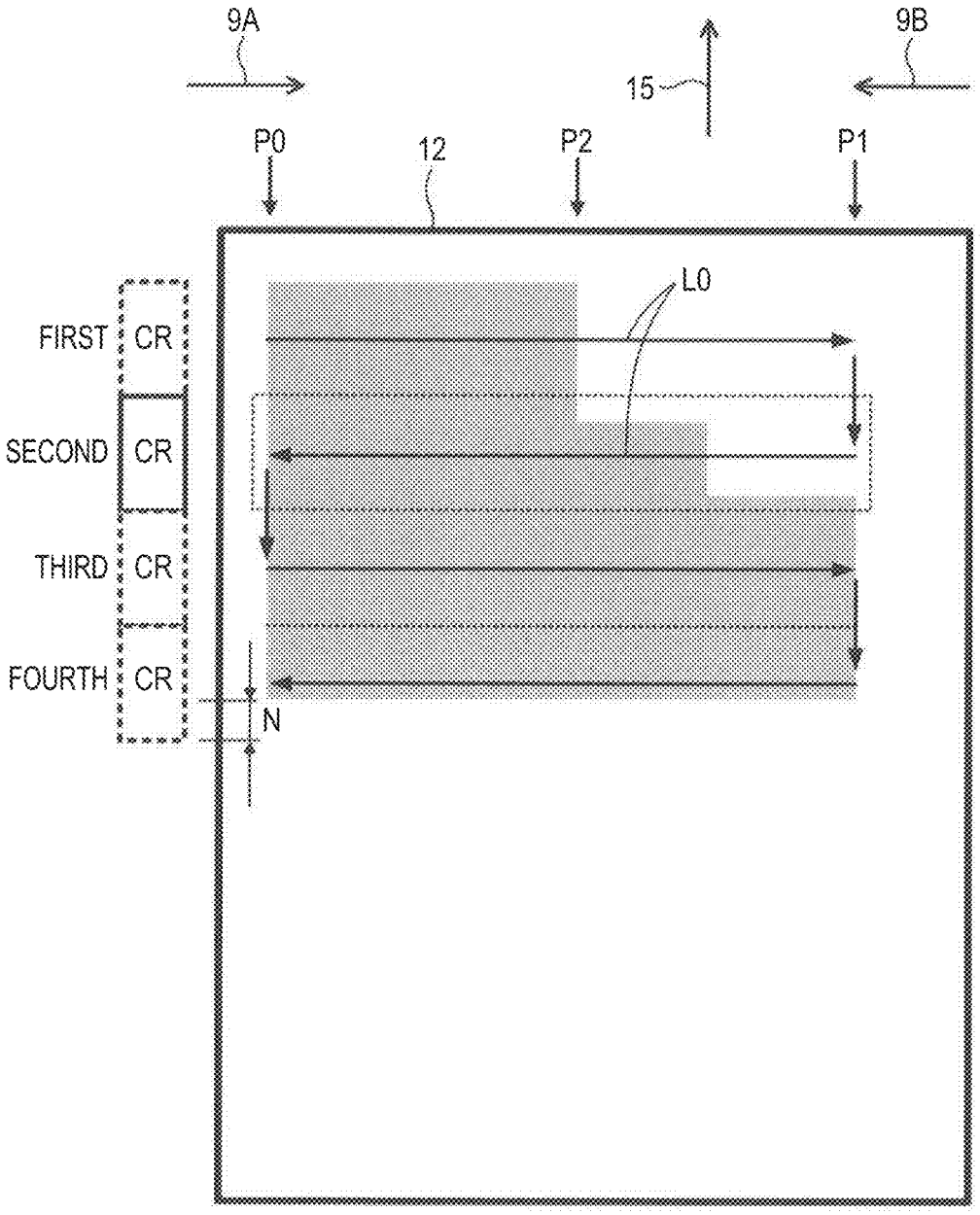
FIG. 13 is a schematic view showing a length L0 of a second pass image in the pass adjustment processing according to a modification.
Figure 14:
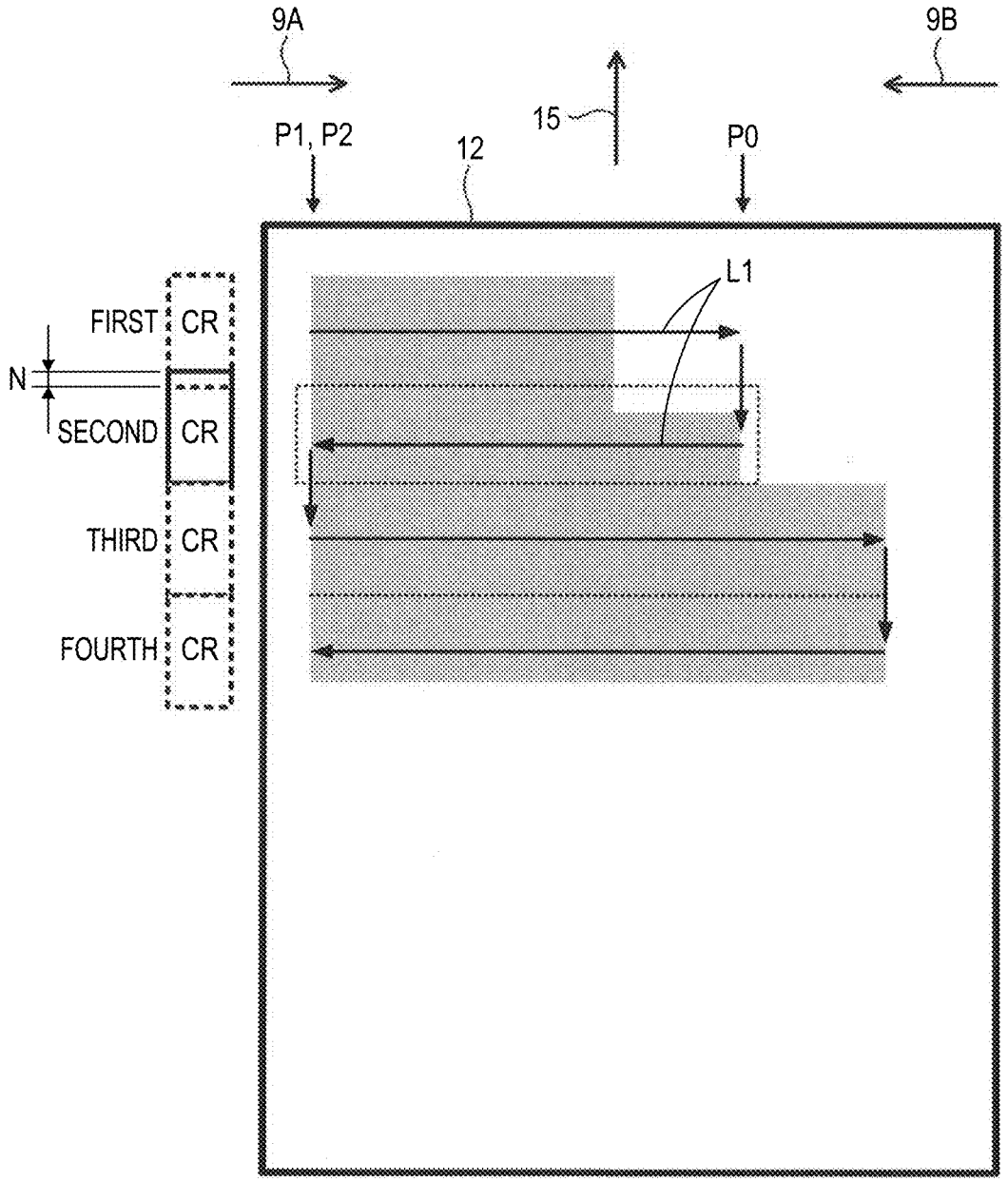
FIG. 14 is a schematic view showing a length L1 of the second pass image in the pass adjustment processing according to the modification.

For example, as shown in FIGS. 13 and 14, in the first pass image and the third pass image, ink is ejected from the nozzles 40 while the carriage 23 is moved in the second direction 9A. In the second pass image and the fourth pass image, ink is ejected from the nozzles 40 while the carriage 23 moves in the third direction 9B. The fourth pass image is the last pass image and the non-usage ratio N exists.

The length L0 and the length L1 in the kth pass image differ depending on the one pass margin information of the (k+1)th pass image. For example, as shown in FIG. 13, regarding the first pass image, the carriage 23 moves from the movement start position P0 in the second direction 9A. The ink ejection for the first pass image is finished at the position P2, but the carriage 23 moves to the left end (the right end in FIGS. 13 and 14) of the second pass image and stops. This stop position P1 is the movement stop position. In the first pass image, the distance M2 from the movement start position P0 to the position P1 which is the movement start position of the second pass image is longer than the distance M1 from the movement start position P0 of the first pass image to the position P2 which is the movement stop position when only the first pass image is recorded. Thus, the distance M2 is the length L0 in the first pass image. That is, the length L0 in this case is the longer one of: a distance from the movement start position (the position P0) to the movement stop position (the position P2) of one pass; and a distance from the movement start position (the position P0) of the one pass to the movement start position (the position P1) of the next pass. In FIG. 13, the length L0 in the second pass image is the same as the length L0 in the first pass image.

Then, as shown in FIG. 14, the length L1 becomes shorter than the length L0 in the second pass image. As a result, the position where the carriage 23 stops in the first pass image also becomes the position P0 in FIG. 14. Thus, the movement distance of the carriage 23 in the first pass image also becomes shorter than the length L0 in FIG. 13.

What is claimed is:

1. An image recording apparatus comprising:

a conveyor configured to convey a sheet in a conveyance direction;

a carriage configured to move in a scanning direction crossing the conveyance direction;

a head mounted on the carriage, the head having a plurality of nozzles arranged in the conveyance direction; and a controller configured to record an image formed by a plurality of passes on a sheet by repeatedly controlling the head to eject liquid from the plurality of nozzles while moving the carriage in the scanning direction, and controlling the conveyor to convey the sheet in the conveyance direction, the controller being configured to:

acquire image recording data including a plurality of pass image data for recording the plurality of passes;

determine, based on the image recording data, a first movement distance of the carriage for recording each of the plurality of passes, the first movement distance being a movement distance of the carriage assuming that each of the plurality of passes is recorded by using all of the plurality of nozzles;

determine, based on the image recording data, a non-usage ratio that is a ratio of a number of unused nozzles in a last pass of the plurality of passes to a total number of the plurality of nozzles arranged in the conveyance direction, the unused nozzles including a most upstream nozzle in the conveyance direction and nozzles continuously arranged from the most upstream nozzle toward downstream in the conveyance direction;

determine, based on the image recording data, a second movement distance in a particular pass which is recorded before the last pass, the second movement distance being a movement distance of the carriage assuming that the particular pass is recorded without using nozzles of a first ratio, the first ratio being smaller than or equal to the non-usage ratio; and in response to determining that the second movement distance is shorter than the first movement distance, perform image recording of the particular pass without using the nozzles of the first ratio.

2. The image recording apparatus according to claim 1, wherein the controller is configured to:

in response to determining that the second movement distance is shorter than the first movement distance, determine a third movement distance in the particular pass, the third movement distance being a movement distance of the carriage assuming that the particular pass is recorded without using nozzles of a second ratio, the second ratio being smaller than the first ratio;

in response to determining that a difference between the third movement distance and the second movement distance is smaller than a particular threshold, perform image recording of the particular pass without using nozzles of the second ratio;

determine a fourth movement distance in a subsequent pass which is recorded after the particular pass, the fourth movement distance being a movement distance of the carriage assuming that the subsequent pass is recorded without using nozzles of a third ratio, the third ratio being a difference between the first ratio and the second ratio; and perform image recording of the subsequent pass without using the nozzles of the third ratio.

3. The image recording apparatus according to claim 1, wherein the controller is configured to:

perform image recording of the plurality of passes only when the carriage moves in one direction of the scanning direction; and determine, as the first movement distance and the second movement distance, a sum of a distance from a movement start position to a movement stop position of one pass and a distance from the movement stop position of the one pass to a movement start position of a next pass.

4. The image recording apparatus according to claim 1, wherein the controller is configured to:

perform image recording of the plurality of passes both when the carriage moves in one direction of the scanning direction and when the carriage moves in an opposite direction opposite the one direction; and determine, as the first movement distance and the second movement distance, a longer one of: a distance from a movement start position to a movement stop position of one pass; and a distance from the movement start position of the one pass to a movement start position of a next pass.

5. The image recording apparatus according to claim 1, wherein the first ratio is equal to the non-usage ratio; and wherein the controller is configured to:

in response to determining that the second movement distance is not shorter than the first movement distance, perform image recording of the particular pass by using all of the plurality of nozzles;

in response to determining that the second movement distance is shorter than the first movement distance, determine a third movement distance in the particular pass, the third movement distance being a movement distance of the carriage assuming that the particular pass is recorded without using nozzles of a second ratio, the second ratio being smaller than the first ratio;

in response to determining that a difference between the third movement distance and the second movement distance is smaller than a particular threshold, perform image recording of the particular pass without using nozzles of the second ratio;

determine a fourth movement distance in a subsequent pass which is recorded after the particular pass, the fourth movement distance being a movement distance of the carriage assuming that the subsequent pass is recorded without using nozzles of a third ratio, the third ratio being a difference between the first ratio and the second ratio; and perform image recording of the subsequent pass without using the nozzles of the third ratio; and in response to determining that the difference between the third movement distance and the second movement distance is larger than the particular threshold, perform image recording of the particular pass without using nozzles of the first ratio, and perform image recording of the subsequent pass by using all of the plurality of nozzles.

* * * * *